United States Patent [19]

Preuss et al.

[11] 4,383,835

[45] May 17, 1983

[54] PROCESS FOR IMPROVING THE LIGHT FASTNESS OF POLYAMIDE DYEINGS WITH COPPER COMPLEXES OF SCHIFF BASES OR ORTHO-HYDROXY BENZOPHENONE

[75] Inventors: Reinhard Preuss, Krefeld; Joachim Grütze, Cologne; Ulrich Beck, Bornheim; Hellmuth Pantke, Leichlingen; Karl Vogel, Cologne, all of Fed. Rep. of Germany

[73] Assignee: Bayer Aktiengesellschaft, Leverkusen, Fed. Rep. of Germany

[21] Appl. No.: 311,490

[22] Filed: Oct. 15, 1981

[30] Foreign Application Priority Data

Oct. 31, 1980 [DE] Fed. Rep. of Germany ..... 3041153

[51] Int. Cl.[3] ..... D06P 1/64; D06P 3/24

[52] U.S. Cl. ..... 8/602; 8/607; 8/608; 8/624; 8/680; 8/685; 8/924; 260/47.75 C

[58] Field of Search ..... 260/45.75 C; 8/602, 8/607, 608, 624

[56] References Cited

U.S. PATENT DOCUMENTS

| | | | |
|---|---|---|---|
| 3,203,752 | 8/1965 | Mills et al. | 8/551 |
| 3,329,696 | 7/1967 | Sparks | 260/45.75 B |
| 3,361,710 | 1/1968 | Sparks | 260/45.75 B |
| 3,363,969 | 1/1968 | Brooks | 8/493 |

FOREIGN PATENT DOCUMENTS

| | | |
|---|---|---|
| 2625386 | 12/1977 | Fed. Rep. of Germany . |
| 967,393 | 8/1964 | United Kingdom . |
| 1321645 | 6/1973 | United Kingdom . |
| 1392953 | 5/1975 | United Kingdom . |
| 1496506 | 12/1977 | United Kingdom . |

OTHER PUBLICATIONS

C. S. Hockins et al., Nature, 1955, 176, (No. 4487), pp. 832–833.

*Primary Examiner*—A. Lionel Clingman
*Attorney, Agent, or Firm*—Sprung, Horn, Kramer & Woods

[57] ABSTRACT

The light fastness of polyamide dyeings can be improved by treating polyamide fibre materials, before, during or after dyeing, with copper complexes of the reaction products of salicylaldehydes with amines (for example cyclohexylamine), or with copper complexes of o-hydroxybenzophenones.

7 Claims, No Drawings

PROCESS FOR IMPROVING THE LIGHT FASTNESS OF POLYAMIDE DYEINGS WITH COPPER COMPLEXES OF SCHIFF BASES OR ORTHO-HYDROXY BENZOPHENONE

The present invention relates to a process for the production of polyamide dyeings having improved light fastness, which is characterised in that the polyamide is treated, before, during or after dyeing, with copper complexes of the reaction products of optionally substituted salicylaldehydes with alkylamines, aromatic diamines or hydrazine (I), and/or copper complexes of optionally substituted o-hydroxybenzophenones (II).

For this purpose, the compounds (I) and (II) are employed in amounts of about 0.05–2%, preferably 0.1–0.2%, relative to the weight of the polyamide. Preferably, the compounds are added to the dyeing bath.

Particularly suitable compounds (I) are those of the formulae

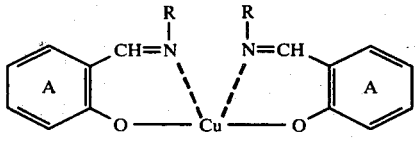

Ia wherein

R=$C_1$–$C_{18}$-alkyl or cycloalkyl, preferably $C_4$–$C_{10}$-alkyl or cyclohexyl,

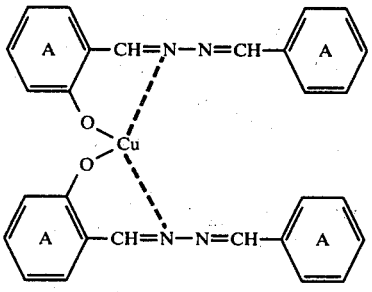

Ib

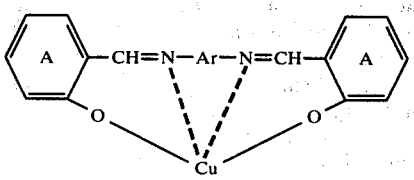

Ic wherein

Ar=arylene, especially optionally substituted 1,4-phenylene or 1,2-phenylene, and

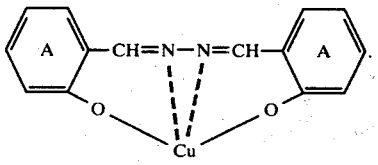

Id

Particularly suitable compounds (II) are those of the formulae:

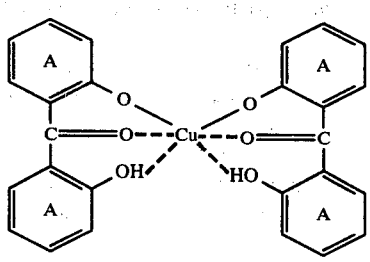

IIa especially the corresponding 4,4'-dialkoxy compounds, and

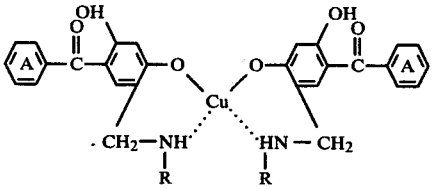

IIb wherein

R=$C_1$–$C_{18}$-alkyl or cycloalkyl, especially $C_4$–$C_{10}$-alkyl or cyclohexyl.

The rings A in these compounds can optionally be substituted, especially by alkyl ($C_1$–$C_4$), cycloalkyl, alkoxy, especially $C_1$–$C_4$-alkoxy, halogen and OH, and the same is true of the radicals Ar.

Preferably, the compounds (I) and (II) are employed in combination with 2-(2'-hydroxyphenyl)benzotriazoles (III) which can optionally be substituted further, especially those of the formula

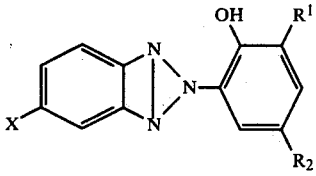

IIIa wherein

X=H or Cl and $R_1$ and $R_2$=H or alkyl, especially $C_1$–$C_4$-alkyl, and/or with O,O'-dihydroxybenzophenones (IV) which can optionally be substituted further, especially 4,4'-dialkoxy-2,2'-dihydroxybenzophenones (IVa).

For this purpose, the compounds (III) and (IV) are employed in amounts of 0.5–4, preferably 1–2%, relative to the weight of the polyamide.

The compounds (I) are obtained in a manner which is in itself known (compare, for example, U.S. Pat. No. 3,361,710) by reacting the corresponding starting compounds with preferably stoichiometric amounts of a copper salt, especially a salt of a mineral acid, such as copper-II chloride, preferably in an alcoholic or aqueous-alcoholic medium.

By polyamide there is to be understood natural and synthetic polyamide.

The dyeings can be produced in a conventional manner, either with metal complex dyestuffs or with acid dyestuffs.

The metal complex dyestuffs employed are the known types, especially the 1:2-chromium complexes or 1:2-cobalt complexes of monoazo or disazo dyestuffs, large numbers of which are described in the literature. The dyestuffs can in particular also contain 1-2 sulpho groups.

Suitable acid dyestuffs are commercially usual types, which, preferably, are employed in combination with the metal complex dyestuffs.

Where the compounds I and II are not water-soluble they are of course employed in the finely divided form, such as is obtained by milling in the presence of customary dispersants.

(1) PREPARATION EXAMPLES (a) Preparation of a compound of the formula

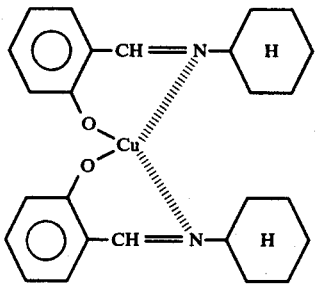

568 g of cyclohexylamine, 683 g of salicylaldehyde and 2.5 l of of toluene are kept refluxing under nitrogen, using a water separator, until no further water is separated off. The toluene is distilled off under reduced pressure. A solution prepared from 196 g of sodium hydroxide and 2 l of methanol is added to the residue and the mixture is heated to the boil for 30 minutes. 448 g of copper-II chloride dihydrate, dissolved in 2 l of methanol, are then rapidly added dropwise, with stirring. After 30 minutes' reflux, the product is filtered off. It can be recrystallised from DMF. Brown crystals, of melting point 165°-168° C., are obtained.

(b) Preparation of the compound of the formula

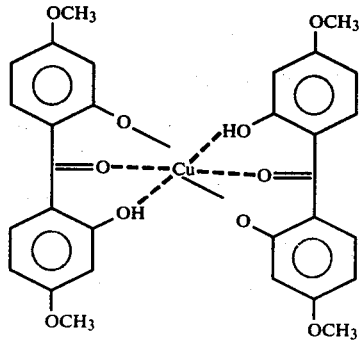

1,100 g of 4,4'-dimethoxy-2,2'-dihydroxybenzophenone, 220 g of sodium methylate and 5 l of ethanol are kept at the reflux temperature for 3 h.

340 g of copper-II chloride dihydrate, dissolved in 3 l ethanol, are then added, with stirring. After 4 hours' boiling under reflux, 5 l of ethanol are distilled off. The residue is extracted by boiling with isopropanol and is filtered off hot. Green-brown crystals of melting range 270°-280° C. are obtained.

(2) APPLICATION EXAMPLES

($a_1$) Exhaustion Process 100 g of polyamide-6 fibres are introduced into 2,000 ml of an aqueous dyeing liquor which contains 0.1 g of the copper complex of the formula (1)

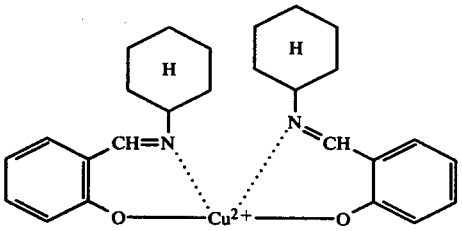

and 0.5 g of the metal complex dye of the formula (2)

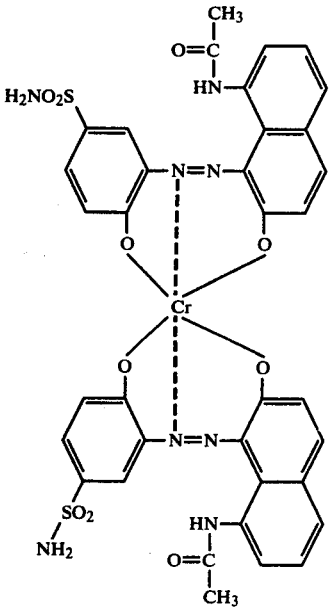

The pH value is adjusted to 6 by adding acetic acid. The temperature of the liquor is then raised, with occasional stirring. Dyeing is carried out for 1 hour at 98° C.

The goods are then taken out of the dyebath and rinsed thoroughly.

The dyeing thus produced shows improved light fastness over the dyeing which has not been treated with (1).

A further improvement of the light fastness is achieved if, in addition to (1), 1.0 g of the compound of the formula (3)

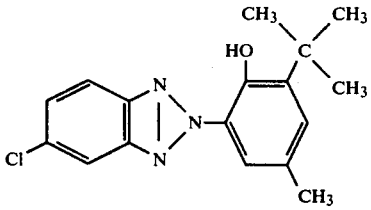

is also added to the dyebath.

The dyeing can also be carried out under HT conditions, that is to say at temperatures of 110°-130° C. in an autoclave.

Similar effects in improvement of light fastness of dyeings on polyamide are obtained if, under the stated application conditions, the copper complex of the formula

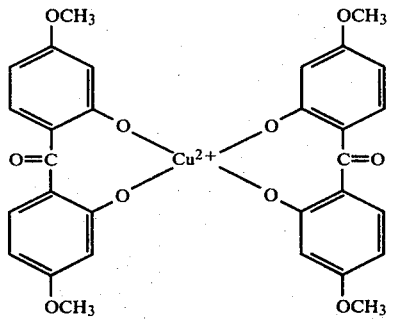

(4)

is employed in place of (1).

A further improvement in light fastness occurs if additionally to substance (4) the compound (3) is added to the dyebath.

A similar improvement in light fastness is achieved if the dyeing liquor contains the copper complex (4) or (4a) instead of compound (1).

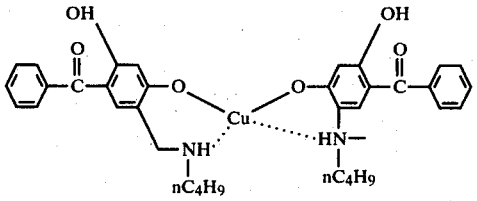

(4a)

(a2) Padding process 100 g of a polyamide-6 fabric are introduced into 2,000 ml of an aqueous dyeing liquor which contains 0.5 g of the metal complex dyestuff of the formula (2). Dyeing is carried out in the usual manner at 98° C. and pH 6. After rinsing, the polyamide fabric is dried and impregnated on a padder with a liquor which contains 1 g of the compound (1), in a dispersed form, per liter of water.

The pressure of the padding rolls is set so that the impregnated polyamide, in the moist state, has twice its dry weight.

The impregnation process is followed by 30 seconds' drying and fixing at 180° C.

The dyeing treated in this way shows improved light fastness over the untreated dyeing.

A further improvement of the light fastness can be achieved by using an impregnating liquor which additionally to (1) contains 10.0 g of compound (3).

A similar improvement in light fastness is achieved if the padding liquor contains the copper complex (4) in place of compound (1).

(b) Acid dyestuffs 100 g of polyamide-6 fibres are introduced into 200 ml of an aqueous dyeing liquor which contains 0.1 g of the compound (1) and 0.5 g of the dyestuff of the formula

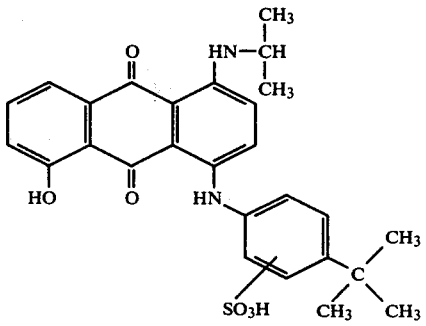

(5)

The liquor is brought to pH 6 and the fibres are dyed for 1 hour at 98° C.

The dyeing thus produced shows improved light fastness over the dyeing which has not been treated with (1).

A further improvement in light fastness is achieved if, additionally to (1), 1.0 g of the compound (3) is added to the liquor.

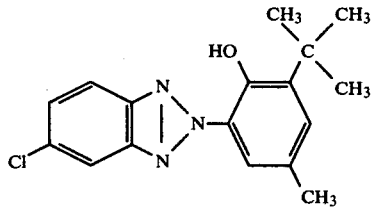

(3)

We claim:

1. Process for improving the light fastness of polyamide dyeings, characterised in that polyamide fibre materials are treated, before, during or after dyeings with a metal complex dyestuff or an acid dyestuff with copper complexes of the reaction products of optionally substituted salicylaldehydes with alkylamines, aromatic diamines or hydrazine (I), and/or copper complexes of optionally substituted o-hydroxybenzophenones (II).

2. Process according to claim 1, characterised in that the copper complexes are added to the dyebath.

3. Process according to claim 1, characterised in that 0.05-2%, relative to the fibre weight, of the copper complexes are employed.

4. Process according to claim 1, characterised in that the copper complexes employed are those of the formula

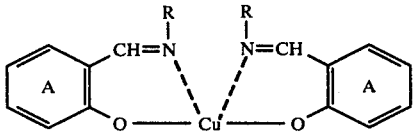

Ia wherein

R denotes $C_1$-$C_{18}$-alkyl or cycloalkyl.

5. Process according to claim 1, characterised in that the copper complexes employed are those of the formulae (Ib)

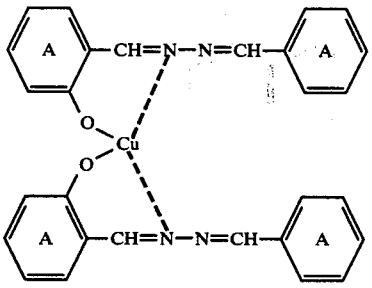

or (Ic)

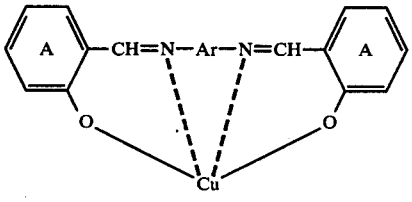

wherein

Ar denotes optionally substituted 1,4-phenylene or 1,2-phenylene.

6. Process according to claim 1, characterised in that the copper complexes employed are those of the formula (IIa)

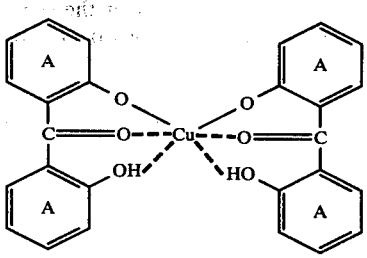

or (IIb)

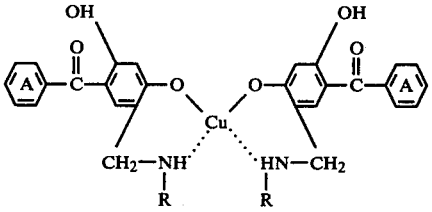

wherein

R denotes $C_1$–$C_{18}$-alkyl or cycloalkyl and the rings A can optionally carry further substituents.

7. Process according to claim 1, characterised in that the copper complexes are employed in combination with 2-(2'-hydroxyphenyl)-benzotriazoles.

* * * * *